US008875782B2

(12) United States Patent
Hart

(10) Patent No.: US 8,875,782 B2
(45) Date of Patent: Nov. 4, 2014

(54) OIL FIELD SYSTEM FOR THROUGH TUBING ROTARY DRILLING

(75) Inventor: Brian Hart, Wakefield Yorkshire (GB)

(73) Assignee: Cameron International Corporation, Houston, TX (US)

( * ) Notice: Subject to any disclaimer, the term of this patent is extended or adjusted under 35 U.S.C. 154(b) by 796 days.

(21) Appl. No.: 12/673,922

(22) PCT Filed: Aug. 13, 2008

(86) PCT No.: PCT/EP2008/060614
§ 371 (c)(1),
(2), (4) Date: May 10, 2010

(87) PCT Pub. No.: WO2009/024507
PCT Pub. Date: Feb. 26, 2009

(65) Prior Publication Data

US 2010/0218955 A1 Sep. 2, 2010

(30) Foreign Application Priority Data

Aug. 22, 2007 (EP) ..... 07114761

(51) Int. Cl.
*E21B 33/06* (2006.01)
*E21B 34/04* (2006.01)
*E21B 33/035* (2006.01)
*E21B 33/064* (2006.01)

(52) U.S. Cl.
CPC ..... *E21B 33/063* (2013.01); *E21B 34/04* (2013.01); *E21B 33/035* (2013.01); *E21B 33/064* (2013.01)
USPC ..... 166/85.1; 166/86.3; 166/379

(58) Field of Classification Search
USPC ..... 166/85.4, 85.1, 86.3, 379, 386; 251/1.3; 137/315.02, 269
See application file for complete search history.

(56) References Cited

U.S. PATENT DOCUMENTS

| | | | | |
|---|---|---|---|---|
| 2,986,367 | A * | 5/1961 | Le Rouax | 251/1.3 |
| 3,273,900 | A * | 9/1966 | Street | 277/323 |
| 3,554,480 | A | 1/1971 | Rowe | |
| 4,940,095 | A * | 7/1990 | Newman | 166/378 |
| 5,765,813 | A * | 6/1998 | Lam et al. | 251/1.3 |

(Continued)

FOREIGN PATENT DOCUMENTS

| | | |
|---|---|---|
| EP | 0416719 A1 | 3/1991 |
| EP | 1319800 A1 | 6/2003 |

(Continued)

OTHER PUBLICATIONS

PCT/EP2008/060614 International Search Report and Written Opinion, Jan. 19, 2009.

*Primary Examiner* — David Andrews
*Assistant Examiner* — Ronald Runyan
(74) *Attorney, Agent, or Firm* — Chamberlain Hrdlicka

(57) ABSTRACT

An oil field system comprising a main body having a bore therethrough, the main body having a connection at one end of the bore for, in use, connecting the main body to an existing wellhead, tree or other oil field equipment, a transverse cavity through the bore, the cavity having at least one opening to the outside of the main body, a plurality of flow control devices for insertion, at different times, into the cavity in order to selectively control fluid flow through the bore, wherein the plurality of flow control devices includes a gate valve and drilling BOP rams.

10 Claims, 3 Drawing Sheets

(56) References Cited

U.S. PATENT DOCUMENTS

| | | | | |
|---|---|---|---|---|
| 6,454,015 | B1 | 9/2002 | Armstrong et al. | |
| 2005/0028980 | A1 | 2/2005 | Page et al. | |
| 2005/0263291 | A1 | 12/2005 | Gass | |
| 2007/0175626 | A1 * | 8/2007 | Lam | 166/85.4 |

FOREIGN PATENT DOCUMENTS

| | | | |
|---|---|---|---|
| WO | 9704210 | | 2/1997 |
| WO | 03014604 | A2 | 2/2003 |
| WO | 2004003338 | A1 | 1/2004 |
| WO | 2004113158 | A2 | 12/2004 |

* cited by examiner

OIL FIELD SYSTEM FOR THROUGH TUBING ROTARY DRILLING

CROSS-REFERENCE TO RELATED APPLICATIONS

This application is a 35 U.S.C. §371 national stage application of PCT Application No. PCT/EP2008/060614, filed 13 Aug. 2008, and entitled Oil Field System for Through Tubing Rotary Drilling, hereby incorporated herein by reference, which claims priority to EP Patent Application No. 07114761.5, filed 22 Aug. 2007, hereby incorporated herein by reference.

STATEMENT REGARDING FEDERALLY-SPONSORED RESEARCH OR DEVELOPMENT

Not applicable.

BACKGROUND

The present invention relates to a Blow Out Preventer (BOP) assembly and a Lower Riser Package (LRP) on an oil or gas field well. The invention is particularly useful in Through Tubing Rotary Drilling (TTRD).

TTRD is a relatively new industry requirement which allows operators to drill through existing production trees and existing well bores to reach additional hydrocarbons in an oil bearing formation. After a period of oil production in a wellhead, the oil bearing formation below the wellhead becomes depleted and fluids or gases may not flow into the well bore and then through the tubing for production. TTRD allows an operator to enter a well and drill a side track into the oil bearing formation without having to remove the tubing and associated production equipment such as an xmas tree from the wellhead.

When drilling down to create the well hole it is necessary to use a BOP assembly. However, in TTRD where an existing wellhead and xmas tree are being drilled through, conventional drilling or a dedicated TTRD BOP stack would be very costly.

A BOP assembly is a multi closure safety device which is connected to the top of a drilled, and often partially cased, hole. The accessible top end of the casing is terminated using a casing spool or wellhead housing to which the BOP assembly is connected and sealed.

The wellhead and BOP stack (the section in which rams are provided) must be able to contain fluids at a pressure rating in excess of any formation pressures that are anticipated when drilling or when having to pump into the well to suppress or circulate an uncontrolled pressurised influx of formation fluid or gases. This influx of formation fluid is known as a "kick" and restabilising control of the well by pumping drilling control fluid (known as mud) to suppress the influx or to circulate the influx out is necessary to control the well. An uncontrolled escape of fluid, whether liquid or gas, to the environment is termed a 'blow out'. A blow out can result in a major leak to the environment which can ignite or explode, jeopardising personnel and equipment in the vicinity, and can result in serious pollution.

Although normal drilling practices provide a liquid hydrostatic pressure barrier for well control, a second safety barrier to contain a kick is provided mechanically by the BOP assembly. The BOP assembly must close and seal on tubular equipment (i.e., pipe, casing or tubing) hung or operated through the BOP assembly and ultimately must be capable of sealing off the well. A general term for a tubular system run into the well is called a string. Wells are typically drilled using a drill string using progressively smaller diameter drill pipes and drill bits. During completion (a term related to bringing a well on stream) or carrying out a workover intervention, various diameter of tubulars, coiled tubing, cable, wireline (including combined bundles) and an assortment of tools are run.

A subsea conventional drilling BOP stack assembly is attached to a wellhead and is provided with a number of pairs of rams to seal around different drill pipe diameters or to shear the drill pipe (in an emergency) and seal the bore. These rams should be rated to perform at pressures in excess of any anticipated well pressures or kick control injection pressures and are typically rated at 10 to 15 kpsi (69-103 MPa). The BOP rams are always used in pairs and when operated, each ram of the pair move towards each other in order to prevent fluid flow through the bore.

An LRP is typically connected to the top of the xmas tree during tree installation or workover and contains a number (usually two) of gate valves and lightweight wireline BOP rams for cutting and/or sealing small diameter workstrings such as wireline, coiled tubing or electrical lines during the completion phase. It should be noted that a drilling BOP stack has more sets of rams (normally a minimum of three sets) compared with the LRP where one set of lightweight BOP rams is usually sufficient. It is worthy of note that drilling BOP rams and associated actuating mechanisms are considerably more expensive than the lightweight BOPs and gate valves.

The term "drilling BOP rams" is well known in the art and is used in this specification to refer to rams that are designed to seal around the drill pipe (sometimes called the drill string) in the event of pressure or a "kick" being encountered during the drilling programme. A different set of rams are usually included in a drilling BOP stack known as shear rams; these rams are used in an emergency and will shear a drill pipe and provide a pressure containing seal against the well.

The term "gate valves" is well known in the art and is used in this specification to refer to valves that are primarily designed as a closure device to provide a pressure seal against gas or liquids (typically oil). Valves have been developed also to cut small diameter work strings (typically, 3.175 mm (0.125") diameter, wireline and, more recently, small diameter drill pipe—up to 73 mm (2⅞") diameter and seal afterwards. Valves, however, cannot be substituted entirely for drilling ram type BOPs as they are not designed for sealing around the drill pipe (drill string).

The lightweight BOP rams discussed in the specification are used in LRPs to provide a cutting and sealing facility in preference to using a gate valve; they can also be used to temporarily suspend wireline (or lightweight drill strings)—this cannot be done with a gate valve. Lightweight rams are often preferred to cutting than gate valves as their sealing capabilities (after cutting) are more reliable.

US 2005/0028980 describes a method of suspending, completing or working over a well. The method set out in this document is to meet statutory safety requirements of having a least two barriers in place during the construction or suspension of wells. The method teaches the use of two deep set barriers in the form of plugs positioned at the end of the completion string. As the two deep set barriers are not higher up in the well bore, both of the barriers can remain in place during suspension and completion operation on the well. This means that a drilling BOP stack is not necessary to provide well control and that during operations on the well, only an LRP is required.

WO 03/014604 describes a method and apparatus for the replacement of an entire BOP stack with a gate valve. A gate valve is described that has a slidable gate with a cutting edge that is capable of cutting through production tubing. According to the teaching in this document, this gate valve eliminates the need for a BOP stack and the drilling BOP rams.

U.S. Pat. No. 6,454,015 describes a gate valve which has a gate which is suitable for shearing small diameter wireline. The gate valve does not provide the same function as drilling BOP.

An aim of the invention is to provide a system which allows the conversion of an LRP into a BOP stack assembly so that a separate BOP stack is not required for Through Tubing Rotary Drilling.

SUMMARY

According to a first aspect of the present invention there is provided an oil field system comprising:

a main body having a bore therethrough, the main body having a connection at one end of the bore for, in use, connecting the main body to an existing wellhead, tree or other oil field equipment;

a transverse cavity through the bore, the cavity having at least one opening to the outside of the main body;

a plurality of flow control devices for insertion, at different times, into the cavity in order to selectively control fluid flow through the bore;

wherein the plurality of flow control devices include a gate valve and drilling BOP rams.

When a gate valve is in position in the cavity, the main body functions as a Lower Riser Package. However, when removed from the bore of the main body and replaced with a drilling BOP ram, the main body is suitable for TTRD or other workover activities and functions as a BOP stack. No machining is necessary in order to replace the gate valve with a BOP assembly. Conventionally, drilling sealing elements (BOP rams) have used elastomeric (rubber) type seals whereas production gate valves have featured metal to metal sealing elements to function within their respective cavities. The two distinct sealing principles have previously been independent of each other. To accommodate the two different types of sealing mechanisms within the same cavity is considered unprecedented.

The main body includes machined preparations to accommodate and provide a sealing facility for either a lightweight ram type BOP, gate valve or drilling ram type BOP. This enables the use of lightweight BOP rams and gate valves when the assembly is used as an LRP (Lower Riser Package) or drilling ram type BOPs in a drilling application. It is not necessary to completely dismantle the entire assembly and replace the body, it is only necessary to change out the respective BOP ram/gate valve sub-assemblies.

The gate valve and drilling BOP rams act to control fluid (or gaseous) flow through the bore, which includes sealing the bore such that they block the bore in order to prevent any flow through the bore or leakage past the gate valve or BOP rams.

The system of the invention can be used in subsea oil wells or land oil wells.

Preferably, the cavity has two openings to the outside of the main body.

Preferably, the cavity is sized and shaped to receive the valve and rams at different times.

The cavity may be non-circular. Alternatively, the cavity may be round, obround or substantially elliptical.

Preferably, the system, further comprises recessed portions in the wall of the bore for receiving valve seats for engagement, in use, with the gate valve. The valve seats may be removable prior to insertion of the ram.

The main body may be a Lower Riser Package when the gate valve is in the cavity.

The main body may be a BOP stack when the ram is in the cavity.

Preferably, the ram is one of a shear/seal ram or a pipe sealing ram.

According to a second aspect of the present invention there is provided a method for converting a Lower Riser Package into a BOP stack, the Lower Riser Package comprising:

a main body having a bore therethrough, the main body having a connection at one end of the bore for, in use, connecting the main body to an existing wellhead, tree or other oil field equipment;

a transverse cavity through the bore, the cavity having at least one opening to the outside of the main body;

a gate valve disposed in the cavity in order to selectively control flow through the bore;

the method comprising the steps of:

removing the gate valve from the cavity; and inserting into the cavity a drilling BOP.

The Lower Riser Package may further comprise a second transverse cavity through the bore having at least one opening to the outside of the main body and a lightweight BOP disposed in the second cavity;

the method may further comprise the step of:

removing the lightweight BOP from the second cavity; and inserting into the second cavity a second drilling BOP.

BRIEF DESCRIPTION OF THE DRAWINGS

The invention will now be described with reference to the accompanying figures, in which.

DETAILED DESCRIPTION OF PREFERRED EMBODIMENTS

Figure 1:
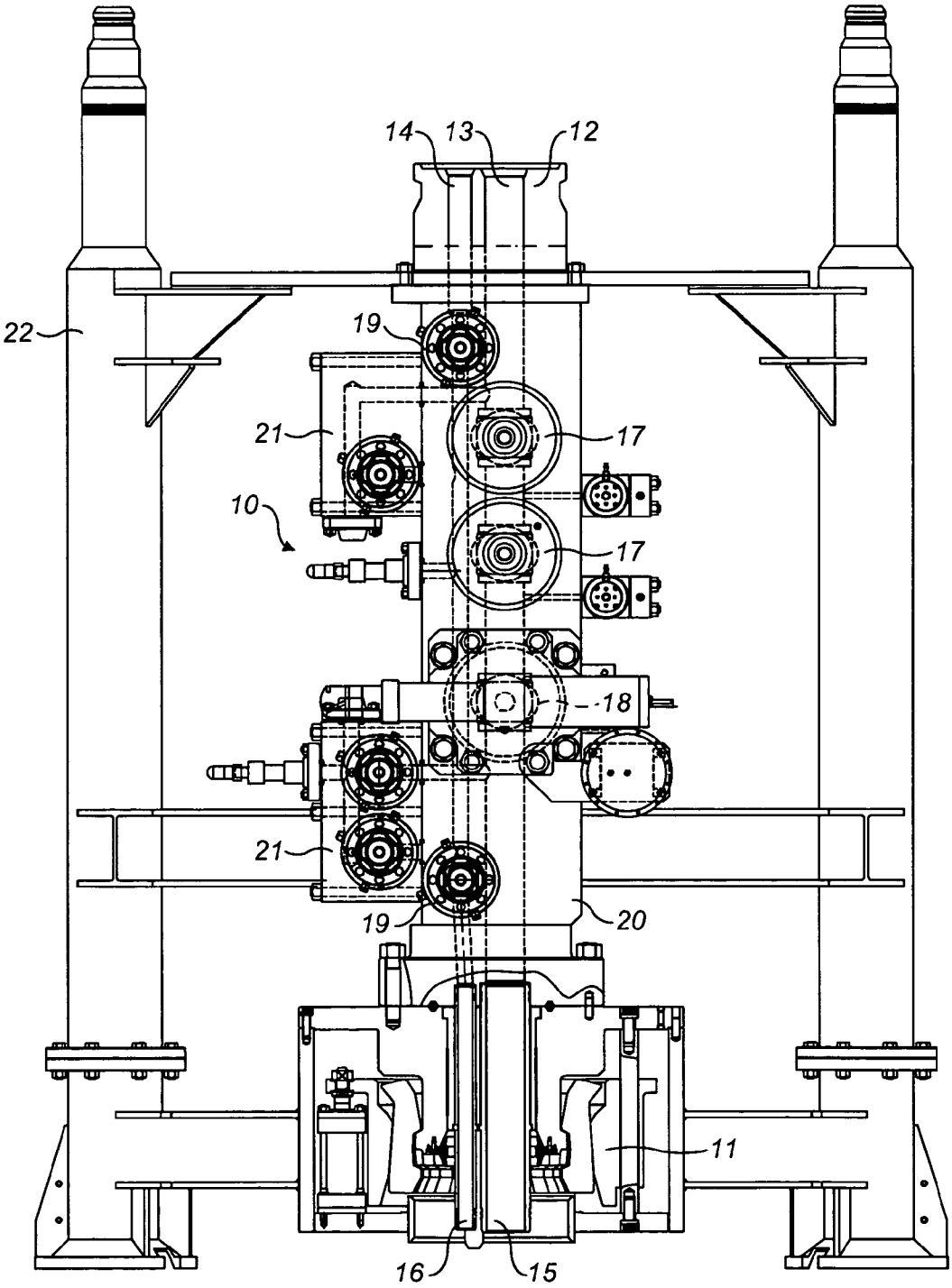
FIG. 1 shows a schematic view of a Lower Riser Package according to the present invention.

FIG. 1 shows a Lower Riser Package (LRP) which in use is attached to the top of an xmas tree by means of an hydraulically actuated connector 11 (the xmas tree is not shown in this drawing). A re-entry hub 12 permits the attachment of an Emergency Disconnect Package (EDP) to the LRP 10. In this example, the LRP comprises a dual bore arrangement, namely a production bore 13 and an annulus bore 14 which extend longitudinally through the LRP. The production bore 13 and annulus bore 14 are arranged such that they are aligned with corresponding bores on the xmas tree and are sealed with the corresponding bores on the xmas tree by means of stab mandrels 15 and 16.

Hydraulically actuated sealing gate valves 17 and an hydraulically actuated shear/seal ram type lightweight blow out preventer 18 are provided to control and prevent fluid flow through the production bore 13.

The annulus bore 14 typically includes sealing gate valves shown at 19. However, BOP rams are not required on the annulus bore 14.

To ensure compactness and provide the maximum strength the gate valves and BOP assemblies are contained within a unitised steel block shown as 20.

Communication between the production bore 13 and the annulus bore 14 is provided by a cross over gate valve 21. This may be used for pressure monitoring and circulation purposes and can be bolted on to the steel block 20.

A steel frame 22 encloses the LRP 10 and provides protection and guidance when installing on the xmas tree.

In the LRP shown in FIG. 1, a combination of gate valves 17 and a lightweight BOP 18 are used to control and prevent fluid flow through the production bore 13. However, it should be noted that an LRP may comprise gate valves only. The use of gate valves or lightweight BOP rams is defined by the operator's requirements in terms of what workstrings the operator anticipates he may need to cut (gate valves will cut small diameter wireline whereas the lightweight BOP will cut larger diameter coiled tubing, electrical lines or combinations of both).

Figure 2:
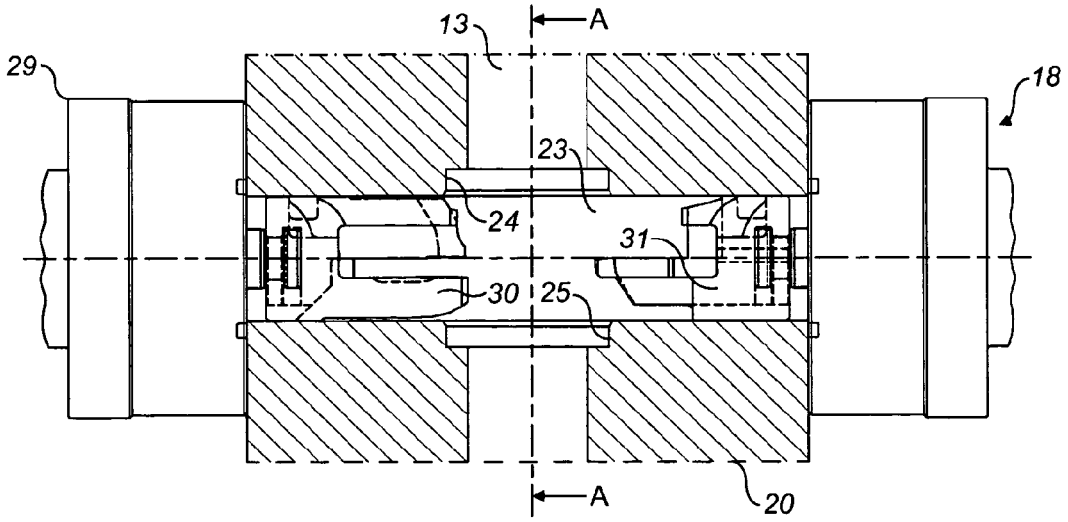
FIG. 2 shows a cross sectional view of a drilling BOP ram in a Lower Riser Package.

As shown in FIG. 2, a drilling BOP ram 29 assembly comprises, in this example, a pair of shear rams 30 and 31. Upper shear ram 30 and lower shear ram 31 are advanced towards each other to seal off the production bore 13 when necessary. As shown in FIG. 2 the production bore 13 is open therefore allowing fluid to flow through.

Upper shear ram 30 and lower shear ram 31 are disposed in transverse cavity 23 which crosses the production bore 13 which has a cross sectional shape compatible with the upper shear ram 30 and lower shear ram 31. The transverse cavity 23 extends through the block 20 and has an opening on each side of the block as shown in FIG. 2. The block 20 is recessed as shown at 24 and 25 so that the transverse cavity 23 can be used with a gate valve, as described below.

Figure 2A:
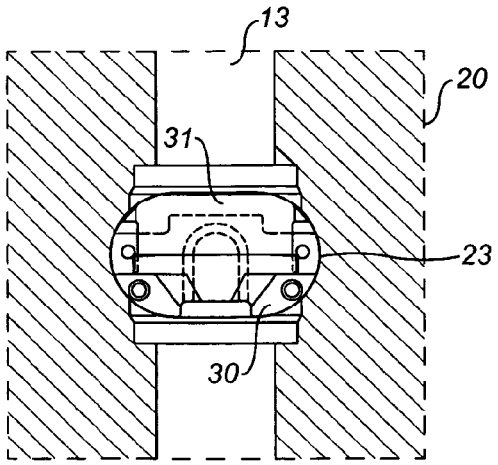
FIG. 2*a* is a cross sectional view across plane A-A of FIG. 2.

Typically, the upper shear ram 30 and the lower shear ram 31 have an obround cross section as shown in FIG. 2*a*.

Figure 3:
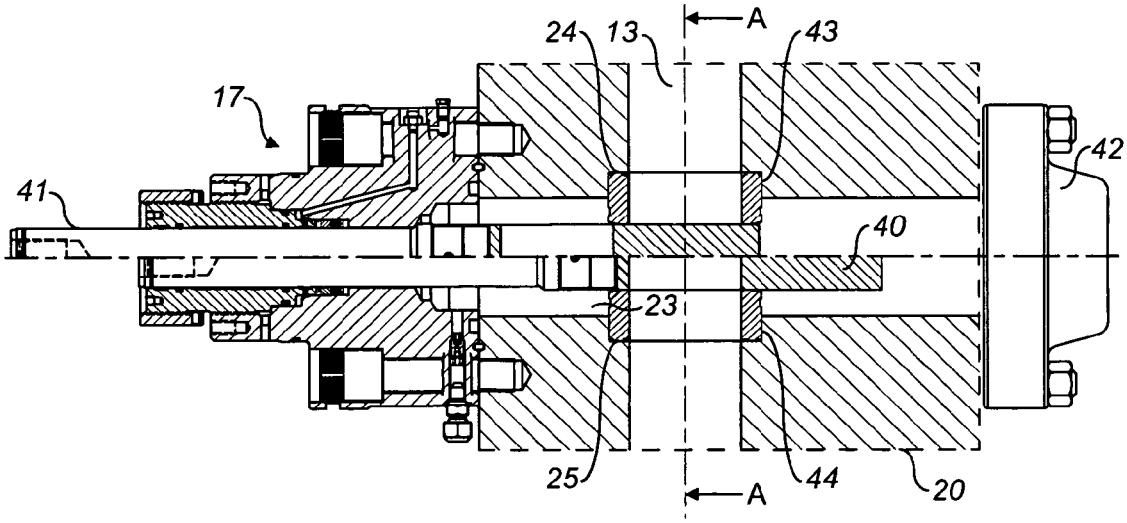
FIG. 3 is a cross sectional view of a gate valve in a Lower Riser Package.
Figure 3A:
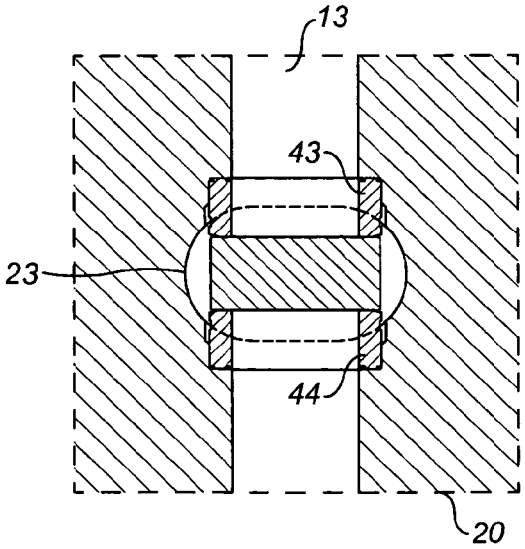
FIG. 3*a* is a cross sectional view across the plane A-A of FIG. 3.

As shown in FIGS. 3 and 3*a*, a gate valve 17 is disposed in the transverse cavity 23 rather than the shear ram of the drilling BOP 29 as in FIG. 2. Gate valve assembly 17 includes a gate 40 attached to a stem 41 which can be closed to prevent the flow of fluid through the production bore 13. As shown in FIG. 3, the gate valve is shown schematically to be open in the bottom half of the diagram and closed in the top half of the diagram. A blind flange 42 is provided opposite to the gate valve assembly 17. The blind flange 42 is used to cover the opening of the transverse cavity 23 when a BOP is not disposed in the transverse cavity.

The gate 40 of the gate valve 17 is typically a flat plate and therefore valve seats 43 and 44 are provided in respective recesses 24 and 25 in order to create a seal with the gate 40.

In order to convert the LRP into a TTRD type drilling BOP stack it is necessary to replace the two gate valves 17 and the lightweight BOP 18 with dedicated drilling BOPs 29 which include appropriate drilling rams and more powerful actuating pistons.

Although this particular example has been described with reference to an obround cavity 23 it should be noted that the cavity can be a number of shapes including circular, non-circular, obround or substantially elliptical.

The replacement of the gate valves 17 and the lightweight BOP 18 by the drilling BOP 29 will not be done when the block 20 is attached to the well. Instead, for a subsea well this operation is performed at the surface on an oil rig.

The invention claimed is:

1. An oil field system comprising:

a main body having a bore therethrough, the main body comprising a connection at one end of the bore for, in use, connecting the main body to an existing wellhead, tree, or other oil field equipment;

a transverse cavity extending along an axis through the bore and comprising openings to the outside of the main body on opposite sides and along the axis;

a plurality of flow control devices for insertion, at different times, into the cavity to selectively control fluid flow through the bore;

wherein the plurality of flow control devices includes a gate valve comprising a single part slidable to close fluid flow through the main body bore and drilling BOP rams designed to seal during drilling operations;

wherein the cavity is shaped so as to be sealable either by the gate valve or the drilling BOP rams to control fluid flow through the main body bore; and wherein the main body comprises recessed portions in a wall of the bore for receiving valve seats for engagement, in use, with the gate valve.

2. A system according to claim 1, wherein the cavity is sized and shaped to receive the valve and rams at different times.

3. A system according to claim 1, wherein the cavity is non-circular.

4. A system according to claim 1, wherein the cavity is round, obround, or substantially elliptical.

5. A system according to claim 1, wherein the valve seats are removable prior to insertion of one of the drilling BOP rams.

6. A system according to claim 1, wherein the main body is operable as a Lower Riser Package when the gate valve is in the cavity.

7. A system according to claim 1, wherein the main body is operable as a BOP stack when the drilling rams are in the cavity.

8. A system according to claim 1, wherein the drilling ram is one of a shear/seal ram or a pipe sealing ram.

9. A method for converting a Lower Riser Package into a BOP stack, the Lower Riser Package comprising:

a main body having a bore therethrough, the main body comprising a connection at one end of the bore for, in use, connecting the main body to an existing wellhead, tree or other oil field equipment;

a transverse cavity extending along an axis through the bore and comprising openings to the outside of the main body on opposite sides and along the cavity axis;

a gate valve comprising a single part slidably disposed in the cavity in order to selectively control flow through the bore; and the main body further comprising recessed portions in a wall of the bore for receiving valve seats for engagement, in use, with the gate valve;

the method comprising:

removing the gate valve from the cavity and the valve seats from the recessed portions in the wall of the bore; and inserting into the cavity a drilling BOP ram so as to be able to seal against the cavity.

10. The method according to claim 9, further comprising:

wherein the Lower Riser Package further comprises a second transverse cavity through the bore having at least one opening to the outside of the main body and a lightweight BOP ram disposed in the second cavity;

removing the lightweight BOP ram from the second cavity; and inserting into the second cavity a second drilling BOP ram.

* * * * *